US008439606B2

(12) United States Patent
Foo et al.

(10) Patent No.: US 8,439,606 B2
(45) Date of Patent: May 14, 2013

(54) CANTILEVER SKIDDING SYSTEM ON A DRILLING RIG

(75) Inventors: Kok Seng Foo, Singapore (SG); Hoe Phong Tham, Singapore (SG); Jacob Alford, New Orleans, LA (US); William T. Bennett, Jr., Houston, TX (US)

(73) Assignees: Offshore Technology Development, Singapore (SG); Offshore Innovative Solutions LLC, Houston, TX (US)

( * ) Notice: Subject to any disclaimer, the term of this patent is extended or adjusted under 35 U.S.C. 154(b) by 444 days.

(21) Appl. No.: 12/677,306

(22) PCT Filed: Sep. 10, 2007

(86) PCT No.: PCT/US2007/077956

§ 371 (c)(1),
(2), (4) Date: Jun. 16, 2010

(87) PCT Pub. No.: WO2009/035448

PCT Pub. Date: Mar. 19, 2009

(65) Prior Publication Data

US 2010/0260555 A1 Oct. 14, 2010

(51) Int. Cl.
*E02B 17/00* (2006.01)

(52) U.S. Cl.
USPC ..... 405/201; 405/202

(58) Field of Classification Search ..... 405/201, 405/195.1, 202
See application file for complete search history.

(56) References Cited

U.S. PATENT DOCUMENTS

| | | | | |
|---|---|---|---|---|
| 3,001,594 | A * | 9/1961 | Suderow | 405/201 |
| 3,244,242 | A * | 4/1966 | Wolff | 405/201 |
| 3,477,235 | A * | 11/1969 | Hester, Jr. et al. | 405/201 |
| 3,921,739 | A | 11/1975 | Rich et al. | |
| 4,065,934 | A | 1/1978 | Dysarz | |
| 4,269,542 | A | 5/1981 | Mueller | |
| 5,407,302 | A * | 4/1995 | Springett et al. | 405/201 |
| 6,171,027 | B1 * | 1/2001 | Blankestijin | 405/201 |
| 6,491,477 | B2 * | 12/2002 | Bennett et al. | 405/201 |
| 6,729,804 | B1 * | 5/2004 | Roodenburg et al. | 405/201 |
| 6,932,553 | B1 | 8/2005 | Roodenburg et al. | |
| 7,083,004 | B2 | 8/2006 | Roodenburg et al. | |
| 2004/0151549 | A1 | 8/2004 | Roodenburg et al. | |

FOREIGN PATENT DOCUMENTS

| | | | |
|---|---|---|---|
| GB | 2139267 | A | 11/1984 |
| GB | 2166176 | A | 4/1986 |

OTHER PUBLICATIONS

Extended European Search Report of corresponding European patent application No. 07814769.1 dated Oct. 25, 2012 (6 pages).

* cited by examiner

*Primary Examiner* — Frederick L Lagman
(74) *Attorney, Agent, or Firm* — Pyprus Pte Ltd

(57) ABSTRACT

The present invention provides an improved cantilever (10) for skidding on a platform (30) of a drilling rig. The cantilever (10) has two longitudinal members (12) while an edge (32) of the platform (30) has two transverse members (14,14*a*). The longitudinal and transverse members are connected at each interposition by a sliding and swivel assembly (20, 20*a*, . . . 20*d*). Each sliding/swivel assembly (20, 20*a* . . . 20*d*) is connected by an actuator (24, 24*a*) to the longitudinal or transverse member so that the cantilever (10) is operable to be displaced on the platform (30) by translation, rotation or a combination of translation and rotation.

20 Claims, 8 Drawing Sheets

CANTILEVER SKIDDING SYSTEM ON A DRILLING RIG

FIELD OF INVENTION

The present invention relates to an improved cantilever skidding system on a platform of a drilling rig. In particular, the invention relates to a system for extending a drill-floor beyond a rectangular area that is conventionally accessible with two orthogonal axes of motion.

BACKGROUND

A typical offshore drilling rig has a platform supported on legs and a cantilever mounted on the platform. Mounted on a drill operation end of the cantilever is a drill floor. The cantilever is moveable in a longitudinal direction of the cantilever such that the drill operation end of the cantilever extends beyond the platform, whilst the drill floor is moveable on the cantilever in a direction transverse to the longitudinal direction. As a result, the drill point can only be located within a rectangular area described by the longitudinal and transverse axes of the cantilever and the drill floor.

The transverse distance covered by the drill floor is limited by the width of the cantilever, which is determined by the distance between cantilever beams extending in the longitudinal direction. To obtain a reasonably wide drilling pattern, the cantilever must also be reasonably wide. Another limitation of the conventional cantilever is that the drill floor creates an asymmetric load on the longitudinal cantilever beams, for example, when the drill floor is moved to a maximal distance in the transverse direction and the longitudinal cantilever beam on the side to which this movement takes place is subjected to a heavier load than the other longitudinal cantilever beam. As a result, each longitudinal cantilever beam must be sturdy and heavily constructed.

Attempts have been made to overcome some of these limitations. For example, U.S. Pat. No. 6,171,027 assigned to Marine Structure Consultants discloses a drill floor that is fixedly mounted on the cantilever so that the load on the longitudinal cantilever beams is centrally or symmetrically located whilst the beams for transverse motion are located on the platform. This design has the advantage that the longitudinal cantilever beams can be of a lighter construction and the range of transverse motion is increased. However, the drilling pattern is still limited by the longitudinal and transverse motions of the cantilever.

U.S. Pat. No. 6,729,804 assigned to Itrec B.V. describes a drilling rig having a platform, a cantilever and a supporting cart disposed between the cantilever and the platform. The supporting cart slides transversely on the platform whilst the cantilever slides longitudinally on the supporting cart on four friction reducing bearings. However, the drilling pattern is still limited by the longitudinal and transverse motions of the cantilever.

U.S. Pat. No. 7,083,004 also assigned to Itrec B.V. describes a drilling rig having a platform, a cantilever and a supporting cart disposed between the cantilever and the platform. The supporting cart pivots about a pivot point on the platform whilst the cantilever slides longitudinally on the supporting cart. The drilling pattern is now part sectorial over the edge of the platform as constrained between two adjacent legs of the drilling rig. U.S. Patent '004 also describes a cantilever with the pivot point being moveable in a direction transverse to the longitudinal direction to create an ellipsoidal drilling pattern. FIG. 1 shows the cantilever described in U.S. Patent '004.

WO 2007/043856 filed by Itrec B.V. describes a rig having a platform and a cantilever. The cantilever has longitudinal rails for extending the cantilever beyond the platform. WO 2007/043856 further discloses rail extensions at the inner end of the longitudinal rails. The rail extensions allow the longitudinal rails to be further extended so that the drilling area is increased.

It can thus be seen that there exists a need for another cantilever skidding system for an offshore platform that allows the drill floor mounted on the cantilever to be moved over a large area and yet overcoming the limitations of the prior art systems, such as, the inconvenience in moving the curved rail 444 of U.S. Pat. No. 7,083,004.

SUMMARY

The following presents a simplified summary to provide a basic understanding of the present invention. This summary is not an extensive overview of the invention, and is not intended to identify key features of the invention. Rather, it is to present some of the inventive concepts of this invention in a generalised form as a prelude to the detailed description that is to follow.

In one embodiment, the present invention provides a drilling rig. The rig comprises: a platform having a pair of substantially parallel transverse members near an edge thereof; a cantilever mountable on the platform, said cantilever having a pair of substantially longitudinal members along the length of the cantilever, said longitudinal members are substantially orthogonal to the pair of transverse members; and a sliding and swivel assembly connecting the longitudinal and transverse members at each interposition of said longitudinal and transverse members such that a sliding/swivel assembly is moveable relatively on the relevant longitudinal or transverse member to translate and/or rotate the cantilever with respect to the platform.

In another embodiment, the present invention provides a method of displacing a cantilever on a platform of a drilling rig. The method comprises: disposing said cantilever on said platform, with said cantilever having two substantially parallel members along the cantilever's longitudinal dimension; disposing two substantially parallel transverse members near an edge of said platform; interconnecting said longitudinal and transverse members by a sliding and swivel assembly at each interposition; and connecting an actuator between a sliding/swivel assembly and said longitudinal/transverse member, wherein said actuator is operable to translate and/or rotate said cantilever with respect to said platform.

In another embodiment of the present invention, the sliding and swivel assembly comprises an upper sliding block, a lower sliding block and a swivel member interconnecting the upper and lower sliding blocks, said upper sliding block is connected to the longitudinal member whilst the lower sliding block is connected to the transverse member. The sliding/swivel assembly also comprises shoulders, necks and annular surfaces to withstand torsion, tension and compression loads, with each pair of mating surfaces having a bearing plate therebetween.

In another embodiment of the present invention, a sliding/swivel assembly is connected by an actuator to the longitudinal member and/or transverse member. In one embodiment, the actuator is a fluid actuator; in another embodiment, the actuator is a screw actuator. In a further embodiment, the actuators are connected in series; in another, the actuators are connected in parallel. In yet another embodiment of the present invention, a sliding/swivel assembly is connected by a rack-pinion assembly to the longitudinal/transverse member.

In a further embodiment of the present invention, the pair of transverse members are unequal in length, with the transverse member near the edge of the platform being longer.

In yet a further embodiment of the present invention, rotation of the cantilever is created by counter-motions of the actuators or racks/pinions associated with the longitudinal members or transverse members or both members.

BRIEF DESCRIPTION OF THE DRAWINGS

This invention will be described by way of non-limiting embodiments of the present invention, with reference to the accompanying drawings, in which.

DETAILED DESCRIPTION

Figure 8:
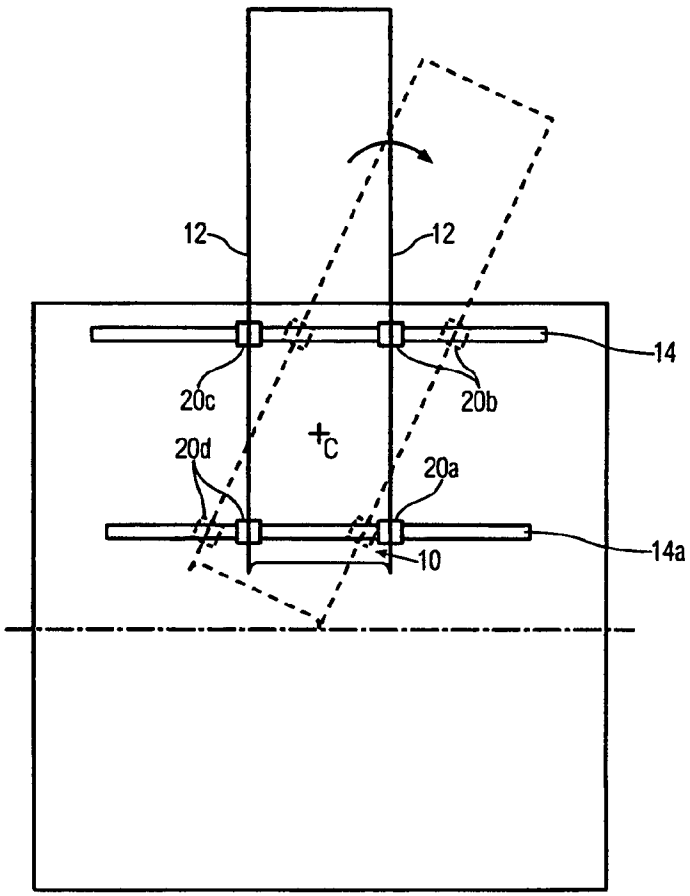
FIG. 8 illustrates rotation of the cantilever of the present invention in a manner that is different from that of a prior art.

One or more specific and alternative embodiments of the present invention will now be described with reference to the attached drawings. It shall be apparent to one skilled in the art, however, that this invention may be practised without such specific details. Some of the details may not be described at length so as not to obscure the invention. For ease of reference, common reference numerals or series of numerals will be used throughout the figures when referring to the same or similar features common to the figures.

Figure 2:
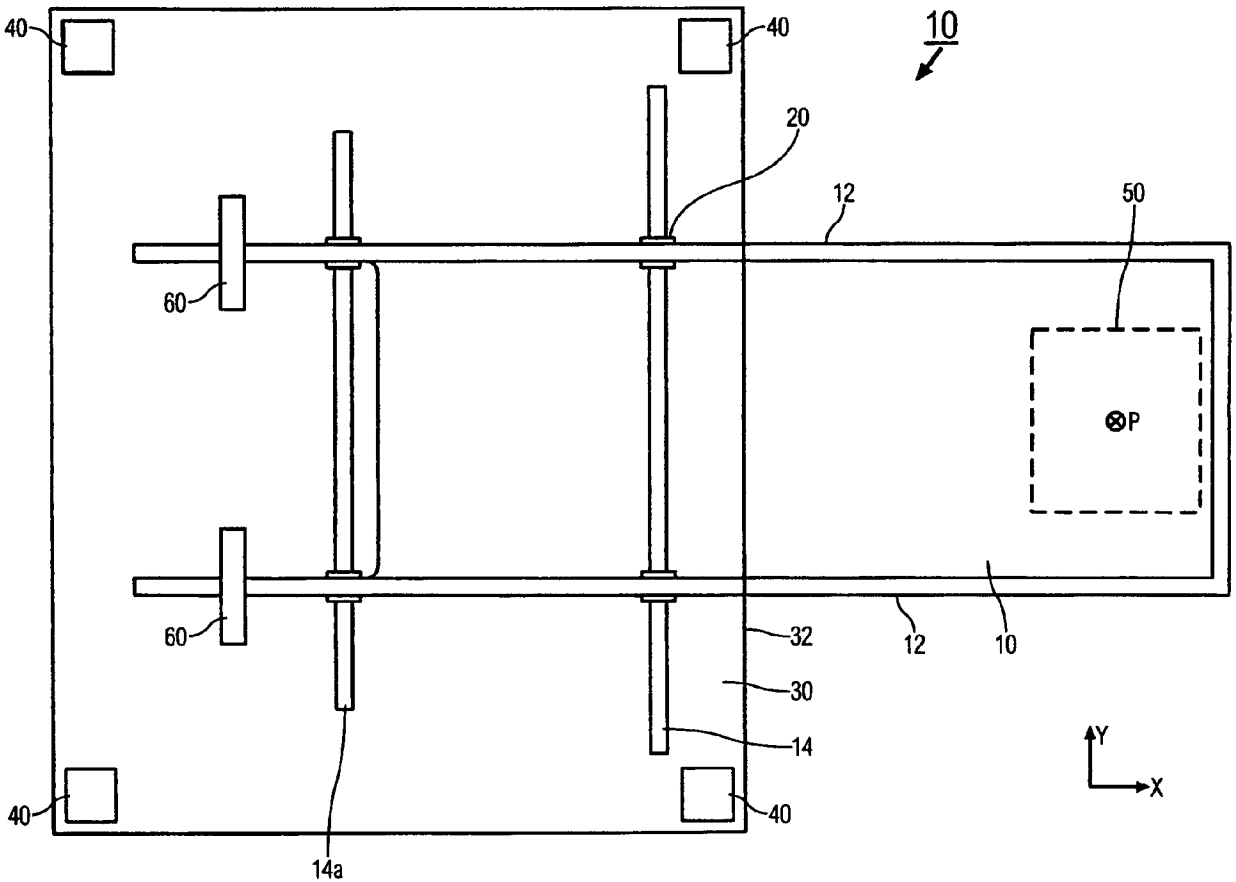
FIG. 2 illustrates a plan view of a cantilever system on a drilling rig in accordance with an embodiment of the present invention.

FIG. 2 shows a plan view of a cantilever 10 system on an offshore platform 30 according to one embodiment of the present invention. As shown in FIG. 2, the cantilever 10 is operable to extend over an edge 32 of the platform 30 in a longitudinal direction of the cantilever or direction X. The platform 30 is supported by four jack-up legs 40. On a distal or operational end of the cantilever 10 is a drill floor 50, which has a drilling axis P extending perpendicular to both the drill floor 50 and the cantilever 10, i.e. in direction Z with reference to the coordinates shown in FIG. 2. Each cantilever 10 has a longitudinal beam or member 12 on each of its two sides. Mounted along the edge 32 of the platform 30 is a transverse beam or member 14, which is substantially orthogonal to the longitudinal members 12, i.e. transverse member 14 is aligned in the Y direction. Substantially parallel to the transverse member 14 is another transverse member 14*a*, the latter being slightly shorter than the former. At each intersection of the longitudinal member 12 and the transverse member 14,14*a*, as seen in the plan view in FIG. 2, is a sliding and swivel assembly 20; altogether, there are four such sliding and swivel assemblies 20*a*, 20*b* . . . 20*d*. In addition, to prevent the cantilever 10 from overturning, two hold-down claws 60 are provided on the cantilever, for example, at an end opposed to the operational end.

Figure 3:
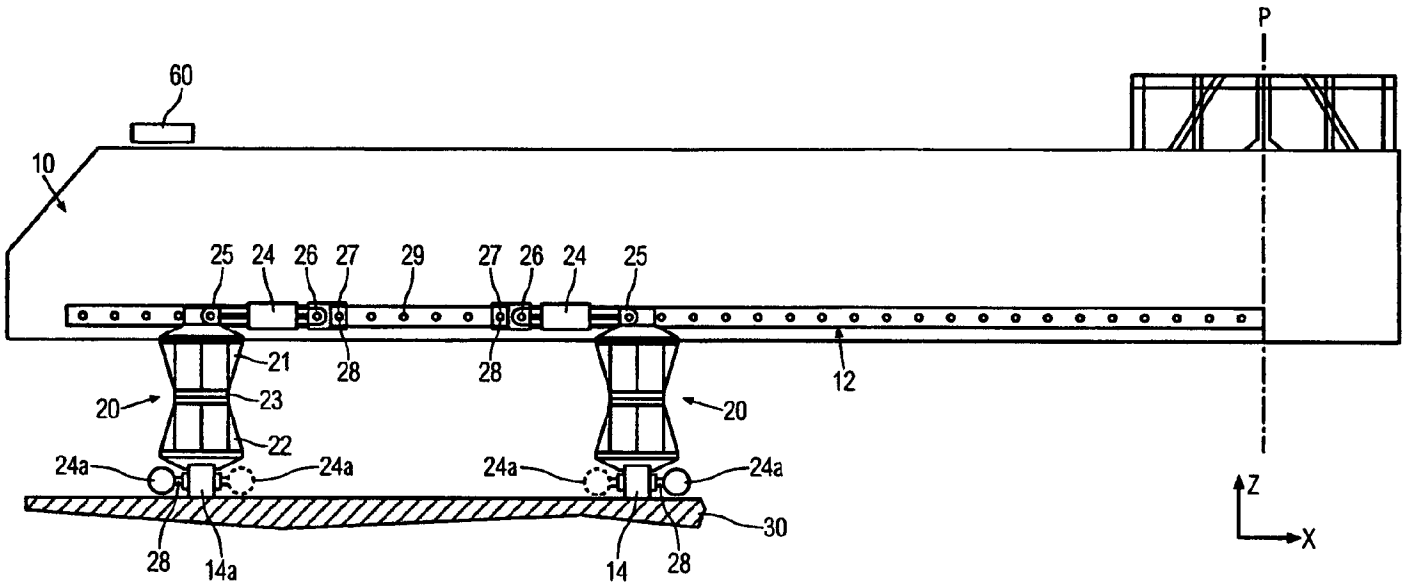
FIG. 3 illustrates a longitudinal section of the cantilever shown in FIG. 2 in accordance with another embodiment of the present invention.
Figure 4:
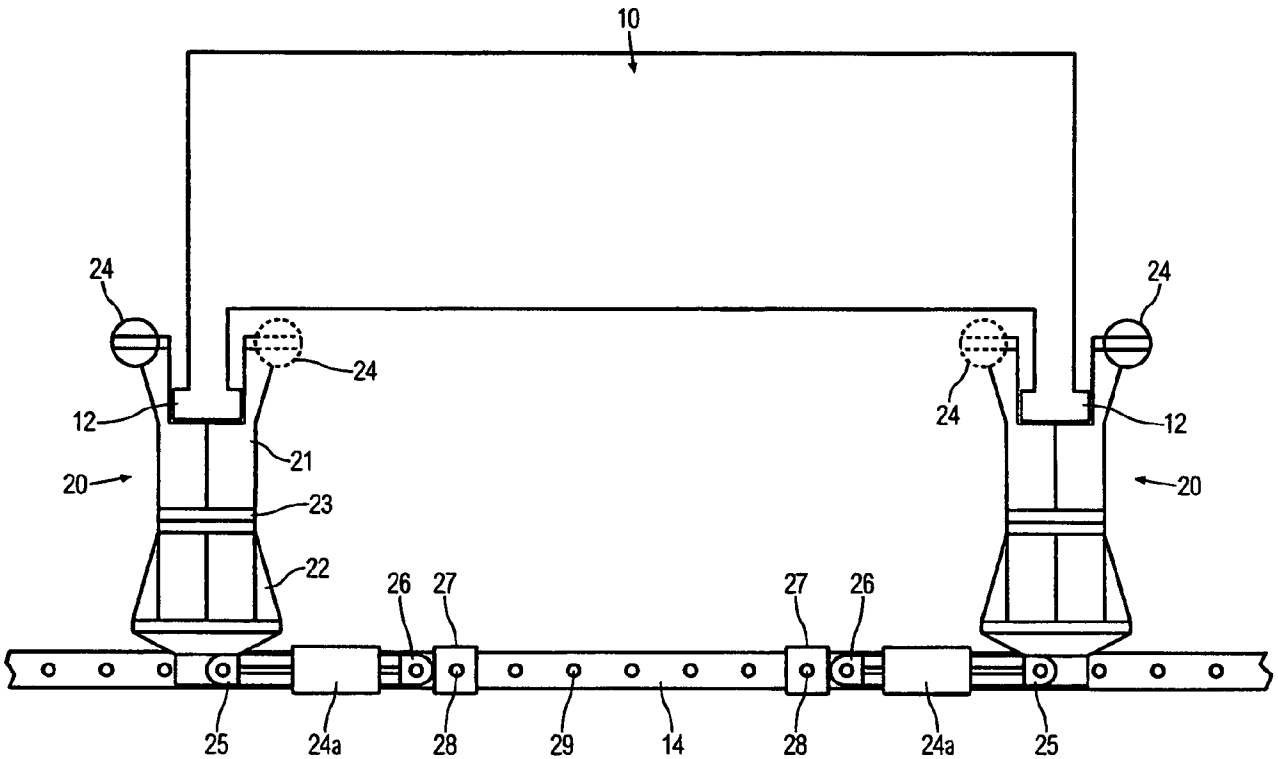
FIG. 4 illustrates a transverse section of the cantilever shown in FIG. 2 in accordance with another embodiment of the present invention.

FIG. 3 shows a longitudinal sectional view of the cantilever 10. FIG. 4 shows a transverse sectional view of the cantilever 10. As shown in FIGS. 3 and 4, each sliding and swivel assembly 20*a*, 20*b* . . . 20*d* inter-connects a longitudinal member 12 with a transverse member 14,14*a*. Each sliding and swivel assembly 20 is made up of an upper sliding block 21, a lower sliding block 22 and an interconnecting swivel member 23. Each sliding/swivel assembly 20 is translated by a fluid actuator 24,24*a* relative to each of the longitudinal 12 and transverse 14,14*a* members. One end of each fluid actuator 24,24*a* is connected by a pin to a connecting end 25 at the sliding/swivel assembly 20 whilst the other (second) end is connected by another pin to another connecting end 26 at a rail block 27 on the relevant longitudinal/transverse member. Each longitudinal/transverse member has a plurality of holes 29 that are equally spaced apart along the member. Each rail block 27 has a bore and a pivot pin 28 for connection with a hole 29 on the respective longitudinal 12 or transverse member 14,14*a*. By shifting the pivot pin 28 on the holes 29 along the associated member 12,14,14*a* and extending/retracting each fluid actuator 24,24*a*, the relevant sliding/swivel assembly 20 is relatively translated intermittently or stepwise on the member.

Figure 5A:
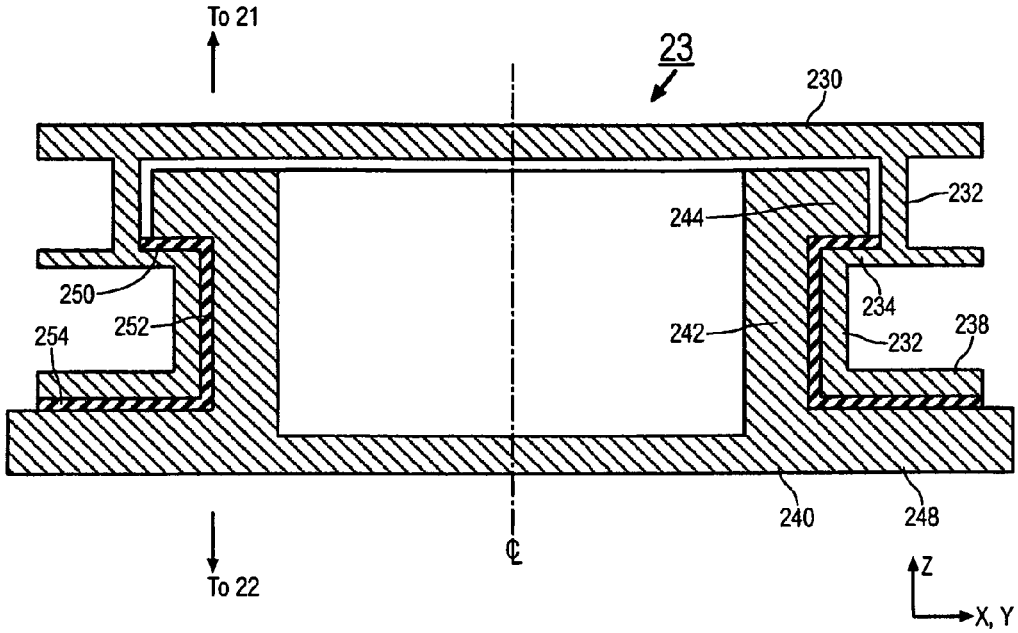
FIG. 5A illustrates a sectional view of a swivel member in accordance with another embodiment of the present invention.

FIG. 5A shows a sectional view of a swivel member 23 according to an embodiment of the present invention. As shown in FIG. 5A, the swivel member 23 has an upper flange 230 and a lower flange 240. An external side of the upper flange 230 is connected to the upper sliding block 21, for example, by bolts and nuts, welding, and so on. Similarly, the external side of the lower flange 240 may be connected to the lower sliding block 22 by bolts and nuts, welding, and so on. An internal side of the upper flange 230 has a two-steps neck 232 and an annular end or flange 238. The two-steps neck 232 defines an internal shoulder 234 therebetween. An external side of the lower flange 240 is connected to the lower sliding block 22 whilst the internal side has a neck 242 that defines a shoulder 244 and an annular flange 248. The internal side of the upper flange 230 engages with the internal side of the lower flange 240 in a rotatory manner through bearing plates 250, 252, 254; that is, the shoulders 234, 244 of the upper and lower flanges 230,240 are rotatory connected by bearing plates 250; the necks 232, 242 are rotatory connected by bearing plates 252; and the annular flanges 238,248 are rotatory connected by bearing plates 254. The interconnecting rotatory surfaces on the internal sides of the upper and lower flanges thus allow relative rotation of the upper flange 230 and lower flange 240, yet allowing each sliding/swivel assembly 23 to withstand tension and compression loads.

Figure 5B:
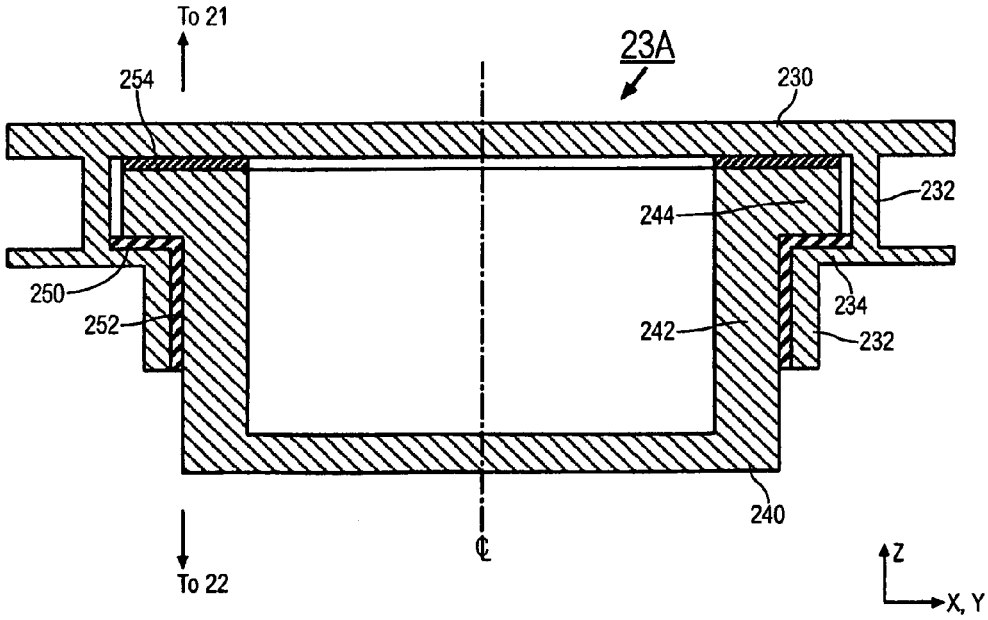
FIG. 5B illustrates a sectional view of a swivel member in accordance with yet another embodiment.

FIG. 5B shows a sectional view of a swivel member 23A according to another embodiment of the present invention. As shown in FIG. 5B, the swivel member 23A is similar to the swivel member 23 except that swivel member 23A does not have the annular flanges 238, 248. Accordingly, the bearing plate 254 is disposed between the shoulder 244 and a lower surface of the upper flange 230.

In use, the fluid actuators 24,24*a* are actuated to extend/retract or push/pull the cantilever 10 in the longitudinal or X-direction, to push/pull the cantilever 10 in the transverse or Y-direction, to rotate the cantilever 10 about the Z-axis, or any combinations of these movements. In one embodiment, the cantilever 10 has a pair of fluid actuators 24 associated with the longitudinal member 12 and a pair of fluid actuators 24*a* associated with the transverse member 14, 14*a*. In another embodiment, the cantilever 10 has two pairs of fluid actuators associated with each of the longitudinal and transverse members. In yet another embodiment, the cantilever 10 has different numbers of fluids actuators associated with the longitudinal and transverse members. For example, to translate the cantilever 10 in the X- or Y-direction, the pair(s) of fluid actuators 24, 24*a* in the relevant direction is/are synchronously actuated to translate the cantilever 10 in an intermittent or stepwise manner.

Figure 6A:
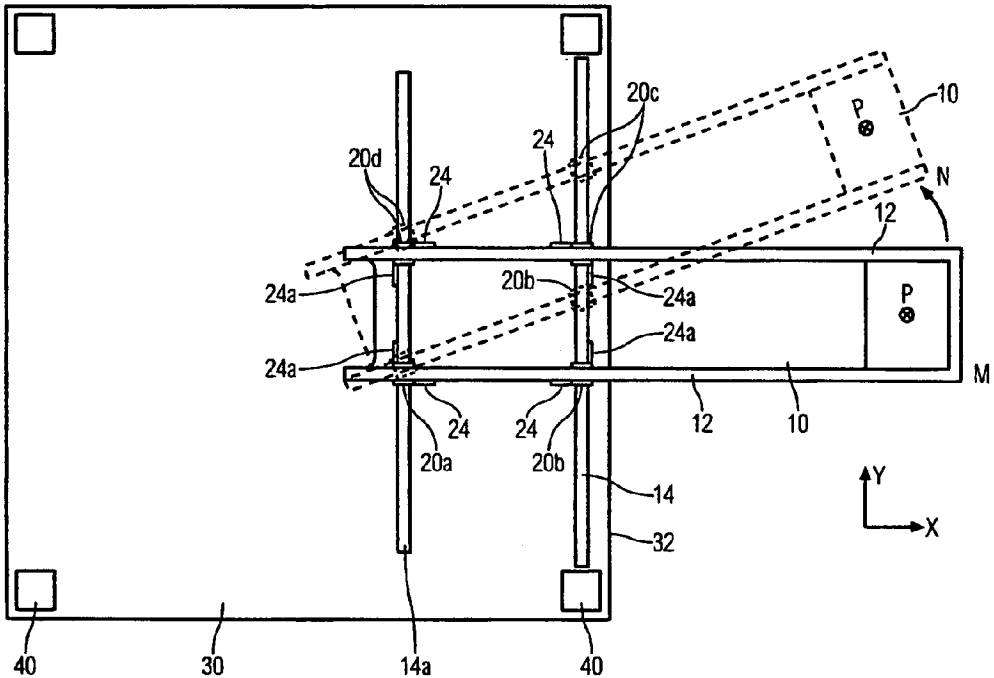
FIG. 6A illustrates rotation of the cantilever about a fixed pivot, whilst
Figure 6B:
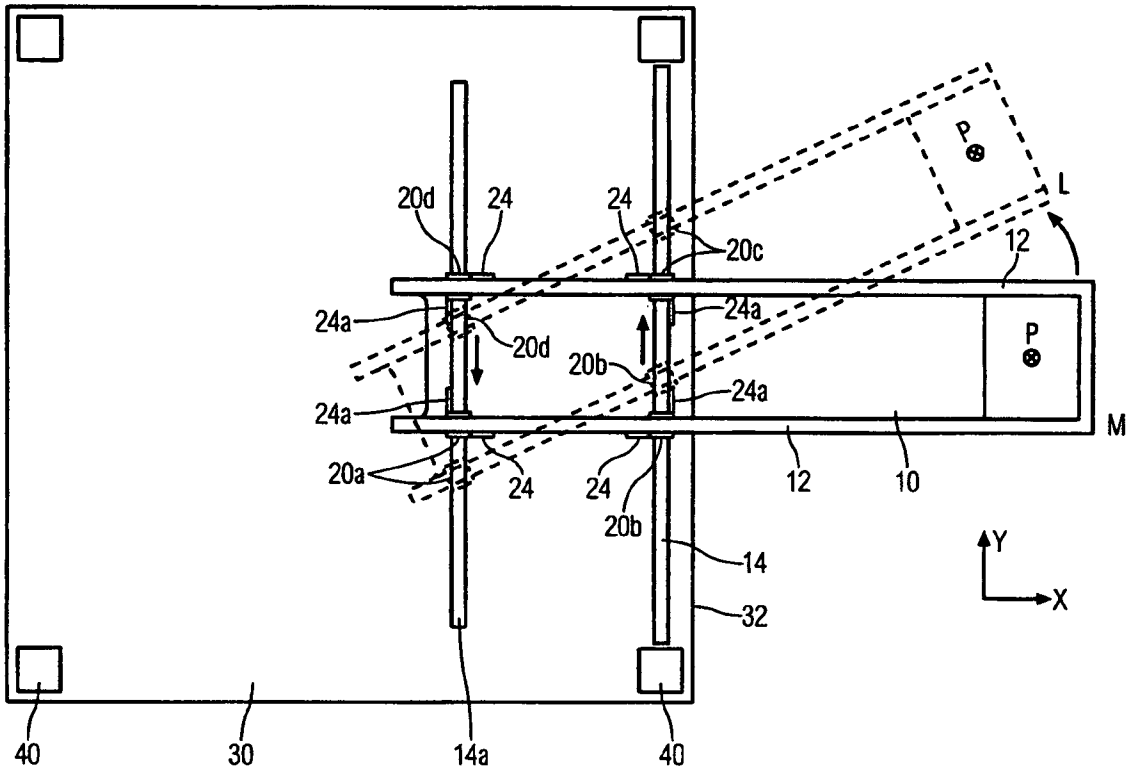
FIG. 6B illustrates rotation of the cantilever by counter-motions of the actuators in accordance with another embodiment of the present invention.

To rotate the cantilever, one or more fluid actuators associated with an adjacent or opposite sliding/swivel assembly or assemblies is/are actuated in cooperation to create a turning moment or torque to rotate the cantilever in the desired direction. For example, FIGS. 6A and 6B show a cantilever 10 with four sliding/swivel assemblies 20*a* . . . 20*d* and a pair of longitudinal fluid actuators 24 associated with the longitudinal member 12 and a pair of transverse fluid actuators 24*a* associated with the transverse member 14, 14*a*. To rotate the cantilever from position M to position N, as shown in FIG. 6A, with the centre of rotation at sliding/swivel assembly 20*a*, the longitudinal fluid actuator(s) 24 associated with sliding/swivel assembly 20*c* and/or 20*d* is/are operated to push/pull separately or synchronously with the transverse fluid actuators associated with sliding/swivel assemblies 20*b*, 20*c* and 20*d* being unlock (or free to extend/retract), or the transverse fluid actuator(s) 24*a* associated with sliding/swivel assembly 20*b* and/or 20*c* is/are operated to push/pull separately or synchronously with the longitudinal fluid actuators 24 associated with sliding/swivel assemblies 20*b*, 20*c* and 20*d* being unlocked (or free to extend/retract), or the longitudinal and transverse fluid actuators are operated cooperatively. Unlocking a hydraulic cylinder includes activating a solenoid to by-pass a motion-lock or brake valve, such as, a piloted check valve connected across the fluid lines of the fluid actuator.

In another example, as shown in FIG. 6B, the transverse fluid actuator 24*a* associated with the sliding/swivel assembly 20*a* is operated in counter-motion with the transverse fluid actuator 24*a* associated with the sliding/swivel assembly 20*b* to create a torque for rotating the cantilever 10 about a virtual centre of rotation lying within the four sliding/swivel assemblies 20. Alternatively, the pair of transverse fluid actuators 24*a* associated with transverse rail 14*a* and the pair of transverse fluid actuators 24*a* associated with transverse rail 14 are similarly operated in counter-motion, as shown by the arrows in FIG. 6B, to rotate the cantilever 10 from position M to position L. In a similar manner, the longitudinal fluid actuator(s) 24 associated with one longitudinal member 12 is/are operated in counter-motion with the longitudinal fluid actuator(s) 24 associated with the other longitudinal member 12 to create a torque to rotate the cantilever 10. Alternatively, a combination of counter-motions or push/pull of both the transverse and longitudinal fluid actuators in synchronous cooperation creates additive torques to rotate the cantilever 10. In the present invention, rotation of the cantilever 10 involves rotation of each of the four sliding/swivel assemblies 20*a* . . . 20*d*.

Figure 7:
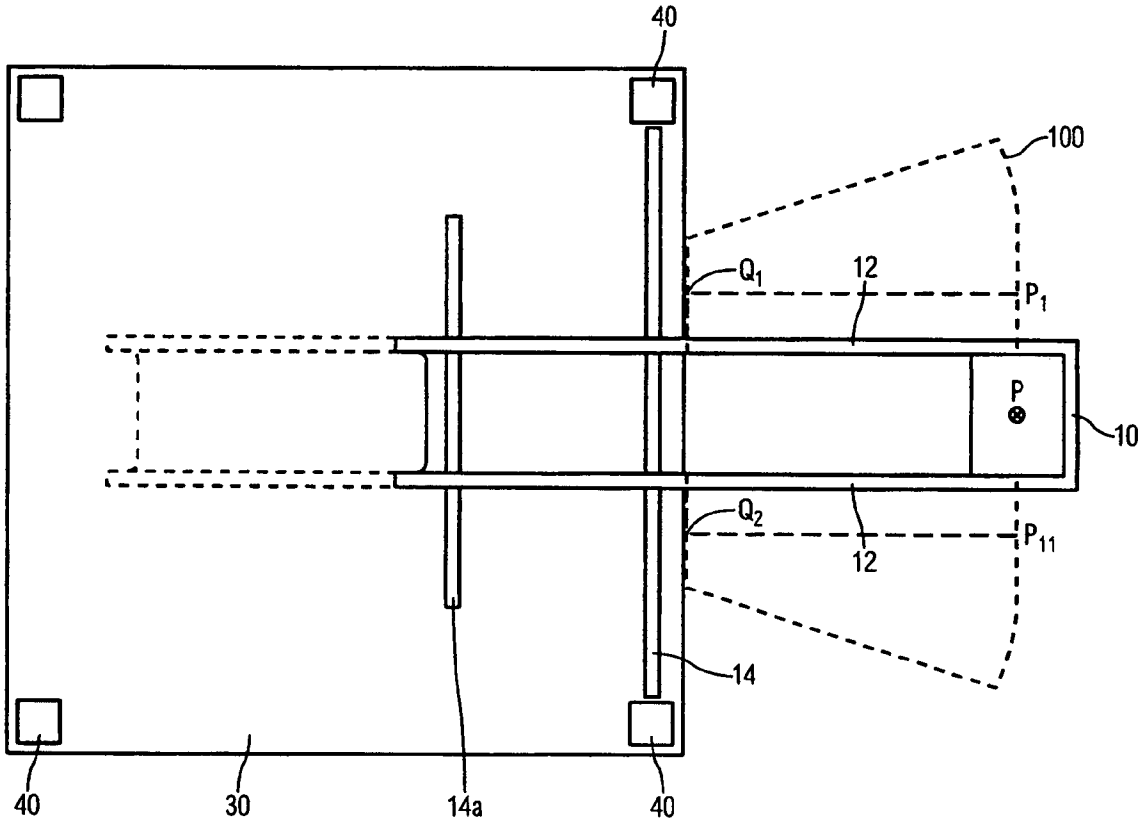
FIG. 7 illustrates a locus of a drilling point created by displacing the cantilever shown in FIG. 2.

FIG. 7 shows a plan view of the cantilever 10 system with the envelop 100 showing the locus of the drilling point P. The envelop 100 is created by a combination of translations of the cantilever 10 on the longitudinal 12 and transverse 14,14*a* members and rotation of the cantilever about the four sliding/swivel assemblies 20. As can be seen from FIG. 7, the envelop 100 of the drilling point P according to the present invention is larger than that described by an envelop of a conventional cantilever, such as the rectangular envelop $Q_1P_1P_{11}Q_2$ described in U.S. Pat. No. 6,717,027.

Figure 1:
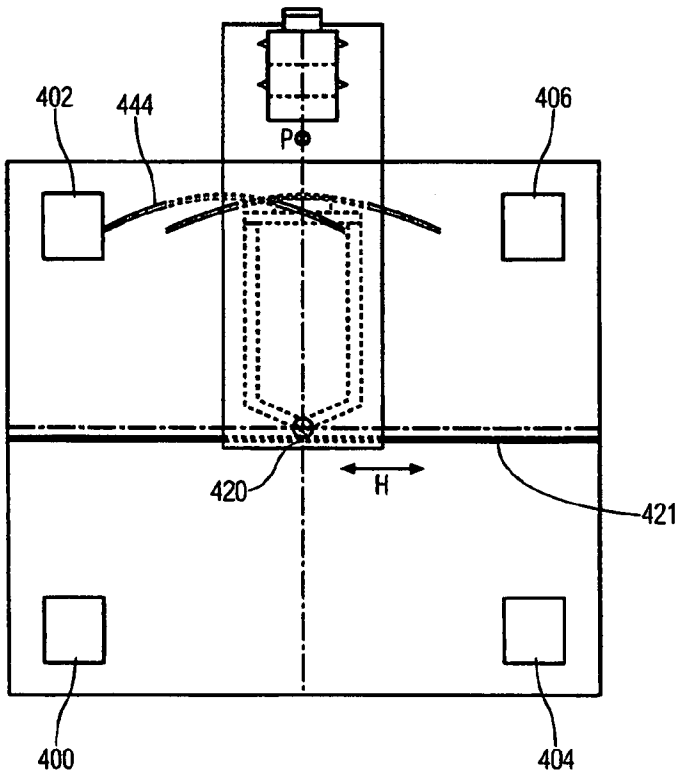
FIG. 1 (PRIOR ART)
FIG. 1 illustrates a known skidding system described in U.S. Pat. No. 7,083,004.

FIG. 8 illustrates rotation of the cantilever 10 system about the four sliding/swivel assemblies 20 without having to move the transverse rails 14,14*a*. In contrast, translation of the cantilever of U.S. Pat. No. 7,083,004, as seen from FIG. 1, involves shifting the curved rails 444; such shifting of the curved rails 444 of U.S. Pat. No. 7,083,004 is laborious and time-consuming; in other words, translation of the curved rails of U.S. Pat. No. 7,083,004 is inconvenient and entails unproductive operation.

In the above embodiments, two or four fluid actuators 24, 24*a* are associated with each of the transverse and longitudinal members. In another embodiment, more than four fluid actuators are possible; one set of cylinders may be used on each of the two sides of the transverse/longitudinal members, that is, the fluid actuators are arranged in parallel. In yet another embodiment, two sets of fluid actuators are arranged in series so that displacement (translation and rotation) of the cantilever 10 can be operated continuously instead of intermittently/stepwise manner.

While specific embodiments have been described and illustrated, it is understood that many changes, modifications, variations and combinations thereof could be made to the present invention without departing from the scope of the invention. For example, the pin 28 on each rail block 27 and the cooperating holes 29 on the transverse/longitudinal member may be aligned vertically (in the Z-direction) instead of horizontally. In addition, the holes 29 need not be equally or uniformly spaced apart on the transverse/longitudinal member. In another example, each longitudinal/transverse member may be translated by means of rack and pinion instead of pin and holes on a rail block. In another example, a screw actuator may be used instead of a fluid actuator. In yet another example, other translation means such as sprocket-chain or pulley-belt system may be used instead of a fluid actuator. Further, the cantilever system of the present invention can also be used on any oil drilling platform having 3 or more legs, on a semi-submersible rig, and so on.

The invention claimed is:

1. A drilling rig comprising:

a platform having a pair of substantially parallel transverse members near an edge thereof;

a cantilever mountable on the platform, said cantilever having a pair of substantially longitudinal members along the length of the cantilever, said longitudinal members are substantially orthogonal to the pair of transverse members; and a plurality of sliding and swivel assemblies connecting the longitudinal and transverse members at each interposition of said longitudinal and transverse members, wherein each of the plurality of sliding and swivel assemblies comprises an upper sliding block, a lower sliding block and a swivel member interconnecting the upper and lower sliding blocks, such that the sliding and swivel assemblies are moveable relatively on the relevant longitudinal or transverse member to translate and/or rotate the cantilever with respect to the platform.

2. A rig according to claim 1, wherein said upper sliding block is connected to the longitudinal member whilst the lower sliding block is connected to the transverse member.

3. A rig according to claim 1, wherein the swivel member comprises shoulders, necks and annular surfaces to withstand torsion, tension and compression loads, with each pair of mating surfaces having a bearing plate therebetween.

4. A rig according to claim 1, further comprising an actuator associated with each longitudinal member and transverse member.

5. A rig according to claim 4, wherein the actuator comprises two or more pairs of actuators.

6. A rig according to claim 5, wherein the pair of actuators associated with a sliding/swivel assembly are connected in series or parallel.

7. A rig according to claim 4, wherein each of the plurality of sliding and swivel assemblies is connected by said actuator to the associated longitudinal member and/or transverse member via a rail block.

8. A rig according to claim 4, wherein the actuator is a fluid actuator, a screw actuator or a rack/pinion assembly.

9. A rig according to claim 1, wherein the pair of transverse members are unequal in length, with said transverse member near the edge of the platform being longer.

10. A method of displacing a cantilever on platform of a drilling rig, said method comprising:

disposing said cantilever on said platform, with said cantilever having two substantially parallel members along the cantilever's longitudinal dimension;

disposing two substantially parallel transverse members near an edge of said platform;

interconnecting said longitudinal and transverse members by a plurality of sliding and swivel assemblies at each interposition, wherein each of the plurality of sliding and swivel assemblies comprises an upper sliding block, a lower sliding block and a swivel member interconnecting the upper and lower sliding blocks; and connecting an actuator between each of the plurality of sliding and swivel assemblies and said associated longitudinal/transverse member, wherein said actuator is or actuators are operable to translate and/or rotate said cantilever with respect to said platform.

11. A method according to claim 10, wherein each said actuator comprises two or more actuators associated with each of the longitudinal and transverse members.

12. A method according to claim 11, wherein two actuators associated with a sliding/swivel assembly are connected in series or parallel.

13. A method according to claim 10, wherein the actuator is a fluid actuator, screw actuator or a rack/pinion assembly.

14. A method according to claim 10, wherein rotation of the cantilever about one of the plurality of sliding and swivel assemblies is executed by actuating one or more actuators associated with one or more of the other sliding and swivel assemblies to create a turning moment about said sliding/swivel assembly.

15. A method according to claim 10, wherein rotation of the cantilever is executed by counter-motions of the actuators associated with the relevant longitudinal members or transverse members, or both members.

16. A method according to claim 10, wherein each sliding and swivel assembly is connected by an actuator to the relevant longitudinal member and/or transverse member by a rail block.

17. A method according to claim 16, wherein the rail block is engageable with holes on the relevant longitudinal and transverse members by a pin.

18. A method according to claim 12, wherein two actuators associated with each sliding and swivel assembly are connected in series so that translation and rotation of the cantilever are operable continuously.

19. A method according to claim 10, wherein said upper sliding block is connected to the longitudinal member whilst the lower sliding block is connected to the transverse member.

20. A method according to claim 19, wherein the swivel member comprises shoulders, necks and annular surfaces to withstand torsional, tension and compression loads, with each mating pair of surfaces having a bearing plate therebetween.

* * * * *